7/2/85 OR 4,525,932

United States Patent [19]

Williams

[11] Patent Number: 4,525,932

[45] Date of Patent: Jul. 2, 1985

[54] FOLDING FIREARM SIGHT

[76] Inventor: Paul D. Williams, 9241 Davison, Davison, Mich. 48423

[21] Appl. No.: 559,749

[22] Filed: Dec. 9, 1983

[51] Int. Cl.[3] ..... F41G 1/40

[52] U.S. Cl. ..... 33/256

[58] Field of Search ..... 33/255, 256, 250, 249, 33/260

[56] References Cited

U.S. PATENT DOCUMENTS

| | | | |
|---|---|---|---|
| 25,663 | 10/1859 | Maynard . | |
| 211,753 | 1/1879 | Lyman . | |
| 396,043 | 1/1889 | Lyman . | |
| 763,790 | 6/1904 | Peddie | 33/256 |
| 1,138,708 | 1/1915 | Windridge . | |
| 1,220,637 | 3/1917 | Johnson . | |
| 1,572,294 | 2/1926 | King . | |
| 1,644,149 | 10/1927 | Redfield . | |
| 2,341,204 | 2/1944 | Browning . | |
| 3,755,910 | 9/1973 | Osborne . | |

FOREIGN PATENT DOCUMENTS

| | | | |
|---|---|---|---|
| 19871 | 8/1910 | United Kingdom | 33/256 |

*Primary Examiner*—Robert I. Smith

*Attorney, Agent, or Firm*—Harness, Dickey & Pierce

[57] ABSTRACT

Folding sight for firearms which may be positively positioned in either an upright operating position or a substantially longitudinal rest position by means of a floating block member in conjunction with a stem support member pivotally connected to said base member.

1 Claim, 5 Drawing Figures

FOLDING FIREARM SIGHT

BACKGROUND AND SUMMARY OF THE INVENTION

This invention relates to firearm sights in general and more particularly to folding-type sights for rifles.

Generally, folding-type sights for rifles are commercially available to the sportsman, hunter, marksman, etc. While these sights are satisfactory in most respects, the present invention provides numerous advantages over those folding sights presently commercially available.

It is desirable that folding-type sights for rifles be positively positionable in an operating position so as to withstand recoil of the rifle upon firing of same, while yielding to a determined effort to fold the sight into a rest position. Further, it is also desirable that such sights be easily mounted and not structurally complex. In addition, folding-type sights should be simple to manufacture and easy to assemble.

The present invention provides a folding sight for rifles which succeeds in fulfilling the above-mentioned desirable features. Applicant's invention positively positions the sight member in an operating or rest position through inclusion of a floating block assembly.

Accordingly, it is a primary object of the present invention to provide a new and improved device which is positively positionable in either an operating or rest position.

Another object of the present invention is to provide a firearm sight which is rapidly and simply folded between an operating or rest position.

Another object of the present invention is to provide a folding firearm sight capable of withstanding the recoil of a discharged firearm substantially without movement from an operating position.

It is a further object of the present invention to provide a folding-type sight which is not structurally complex and easy to assemble.

A still further object of the present invention is to provide a folding-type sight which is relatively economical to manufacture.

A further object of the present invention is to provide a folding-type sight that may be easily mounted on a rifle or other firearm.

Other objects, features and advantages of the present invention will become apparent from the subsequent description and the appended claims.

DESCRIPTION OF THE PREFERRED EMBODIMENT

Figure 1:
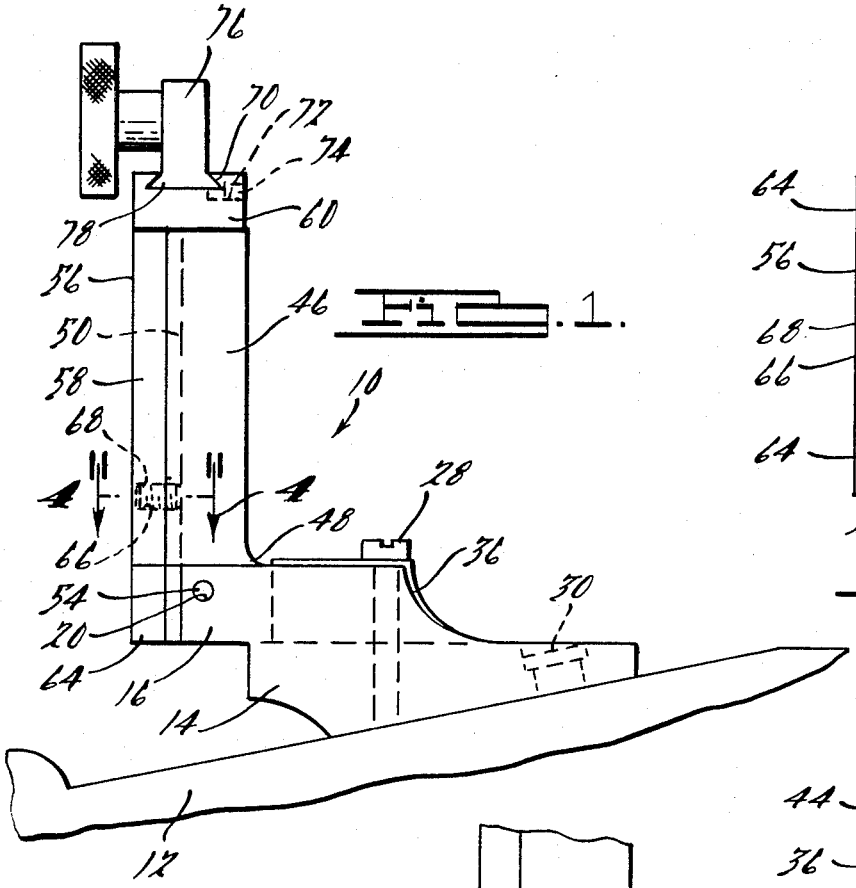
FIG. 1 is a side elevation view of the folding firearm sight of the present invention in its operating position.

Referring now to the drawings, and in particular to FIG. 1, one embodiment of the present invention is disclosed. Folding-type firearm sight 10 generally includes a base member 14, a floating block member 36, spring 44, a stem support member 46, a windage and elevation stem member 56, a sight base 60 and a sight member 76.

Base member 14 is generally of irregular shape and mounted on firearm stock 12 by suitable mounting means such as screws 28 and 30. Base member 14 includes substantially parallel guide portions 16 and 18 projecting generally upwardly therefrom defining a floating block receiving trough therebetween. Said guide portions 16 and 18 extend beyond the rearward face of said base member 14 defining a stem support member receiving area therebetween. Each of said guide portions includes a pivot pin receiving hole 20 and 22, respectively. Holes 24 and 26 are also provided in base member 14 to accommodate screws 28 and 30 or other suitable mounting means.

Base member 14 further includes a seating portion 32 located on its lower face. Seating portion 32 generally corresponds in shape to the lower face of base member 14 and is smaller in area, thereby defining stock seating shoulder 34.

Figure 5:
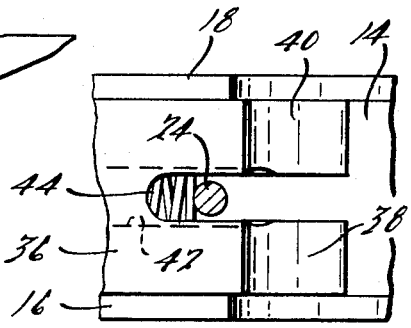
FIG. 5 is a top view taken substantially along lines 5—5 of FIG. 2.
Figure 2:
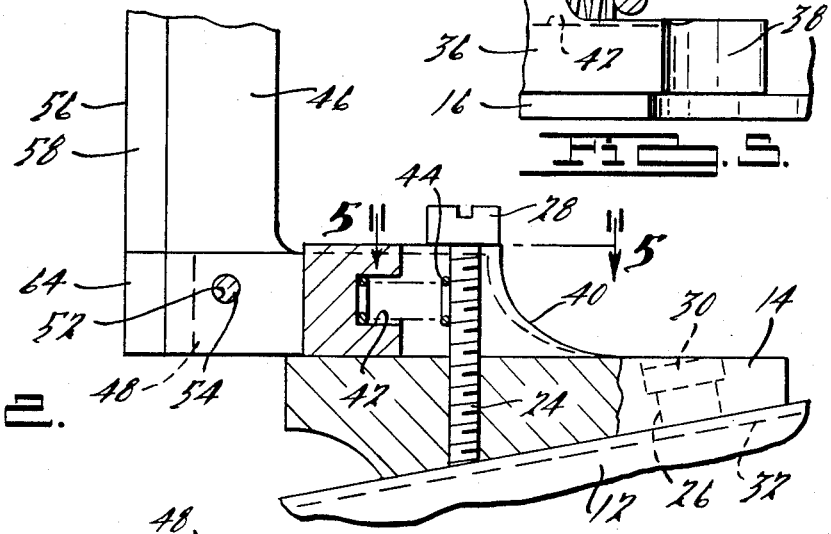
FIG. 2 is a partial view of the folding firearm sight in an operating position with one guide member removed and showing the floating block member and base in cross-section.

Slidably positioned in said floating block receiving trough formed by said guide portions 16 and 18 of base member 14 is floating block member 36. Floating block member 36 is generally rectangular in shape and includes substantially parallel arms 38 and 40 which define a generally U-shaped portion, as can be seen in FIG. 5. Arms 38 and 40 are generally rectangular in cross-section and substantially parallel to said guide portions 16 and 18 of base member 14 and extend from floating block member 36 toward the forward face of said base member 14. Screw 28 is positioned between arms 38 and 40.

Floating block member 36 further includes spring bore 42 positioned between and intermediately of said arms 38 and 40. As can be seen in FIG. 5, spring bore 42 is in part defined by concave recess portions on interior opposing faces of arms 38 and 40 and extends into floating block member 36.

Spring 44 is positioned in spring bore 42. One end of spring 44 seats against the interior face of spring bore 42 and the other end of spring 44 seats against screw 28. Spring 44 may be of any suitable type such as, but not limited to, coil or helical type springs.

Stem support member 46 is generally longitudinal in shape and substantially square in cross-section and includes an enlarged trilateral projecting portion 48 substantially at one end thereof. Stem support member 46 further includes dovetail groove 50 on one side generally extending the length of said stem support member suitable for slidably engaging a dovetail projection on said windage and elevation stem member 56. Trilateral projecting portion 48 of stem support member 46 includes pivot pin hole 52 and is positioned between and pivotally connected to guide portions 16 and 18 of base member 14 by means of pivot pin 54. Pivot pin 54 is securely positioned within pivot pin receiving holes 20 and 22 of base member 14 and pivot pin hole 52 of stem support member 46.

Figure 4:
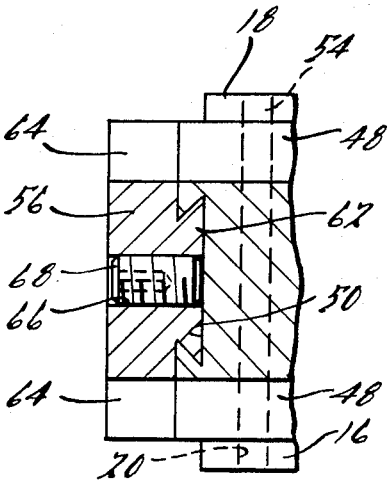
FIG. 4 is a partial cross-sectional view taken substantially along line 4—4 of FIG. 1.

Windage and elevation stem member 56 includes a generally longitudinal member 58 and sight base 60. Longitudinal member 58 of windage and elevation stem member 56 is generally rectangular in cross-section and includes dovetail projection 62 extending along one face thereof for substantially its entire length for slidably engaging dovetail groove 50 of stem support member 46. Further included on longitudinal member 58 is bilateral projecting portion 64 generally corresponding to two sides of trilateral projecting portion 48 of stem support member 46. As can be seen in FIG. 4, longitudinal member 58 further includes set screw hole 66 through which securing means 68 may be positioned. After sliding windage and elevation stem member 56 to a desired elevation, securing means 68 may be tightened to prevent movement of said windage and elevation stem member.

In the preferred embodiment, sight base 60 is formed integral with longitudinal member 58 although they may be manufactured separately and fixedly secured together. Sight base 60 is generally rectangular in shape and perpendicularly positioned on a transverse surface of longitudinal member 58 opposite said bilateral projecting portion 64. Sight base 60 further includes dovetail groove 70 for slidably engaging sight member 76, and set screw hole 72 accommodating securing means 74.

Sight member 76 is shown in FIG. 1 as a peep style sight. It is contemplated that alternative type sights may be utilized with the present invention, such as, but not limited to, an open type sight. Sight member 76 includes dovetail projection 78 for slidably engaging dovetail groove 70 of sight base 60. After sliding sight member 76 to a desired position on sight base 60, securing means 74 may be tightened to prevent further movement of sight member 76.

FIG. 1 shows folding firearm sight 10 in an operating or upright position. Base member 14 is secured to the stock portion 12 of a firearm by suitable mounting means such as screws 28 and 30. Floating block member 36 is slidably positioned between guide portions 16 and 18 of base member 14 and retained in such position by the head of screw 28. Further, spring 44 forces floating block member 36 into engagement against one face of trilateral projecting portion 48 of stem support member 46. An operator may move folding firearm sight 10 to its rest position, shown in FIG. 3, by manually grasping stem support member 46 and windage and elevation stem member 56 and exert a sufficient amount of generally downward force to pivot the upstanding portion of folding firearm sight 10 about pivot pin 54 toward its rest position. The force thereby supplied causes floating block member 36 to slide between guide portion 16 and 18 of base member 14. In its rest position, spring 44 again forces floating block member into engaging contact against a transverse surface of stem support member 46.

Figure 3:
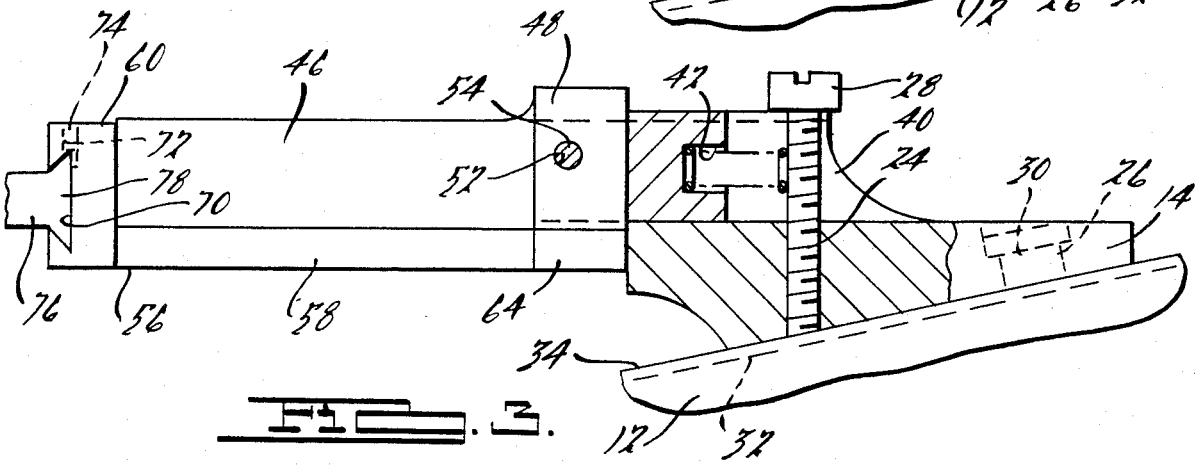
FIG. 3 is similar to FIG. 2 except the present invention is shown in its rest position.

As can be seen in FIGS. 1 and 3, the area of engaging contact between stem support member 46 and floating block member 36 along with the force provided by spring 44 substantially inhibits pivotal movement of the folding portion of folding firearm sight 10 except as desired by the operator.

It will be appreciated that the present invention is susceptible to modification, variation and change without departing from the proper scope or fair meaning of the accompanying claims.

I claim:

1. A folding sight for a firearm adapted to be movable from a storage to an operational position, said sight comprising;

a base adapted to be mounted to said firearm, said base having one or more fastener bores and having a pair of generally upwardly projecting walls which define a trough, one or more elongated fasteners installed within said fastener bore for attaching said base to said firearm, a floating block slidable within said base trough and having a slot which receives said fastener thereby permitting relative movement thereto, said block further having a blind bore extending in the direction of sliding movement of said floating block in said base, a coil spring member installed in said blind bore such that one end of said spring is coupled to said floating block and another end of said spring engages said fastener, thereby biasing said floating block away from said fastener, a stem support pivotably engaging said base walls and disposed in said trough such that said floating block is urged into contact with said stem support, said stem support having a pair of adjacent substantially flat surfaces such that as said stem is biased to remain in the rest and operational positions, said stem support having a first elongated channel, a windage and elevation stem member engaging said stem support elongated channel and defining a second elongated channel extending in a direction perpendicular to said first elongated channel, and a sight member slidably engaged by said windage and elevation stem member second elongated channel.

* * * * *